US005251872A

United States Patent [19]

Kodaira

[11] Patent Number: 5,251,872

[45] Date of Patent: Oct. 12, 1993

[54] AUTOMATIC CLEANER FOR MALE URINAL

[75] Inventor: Makoto Kodaira, Ota, Japan

[73] Assignee: Uro Denshi Kogyo Kabushiki Kaisha, Tokyo, Japan

[21] Appl. No.: 909,052

[22] Filed: Jul. 2, 1992

[30] Foreign Application Priority Data

Jul. 2, 1991 [JP] Japan ..... 3-50938[U]

[51] Int. Cl.[5] ..... E03D 13/00

[52] U.S. Cl. ..... 251/129.04; 4/304; 4/305; 4/DIG. 3

[58] Field of Search ..... 251/129.04; 4/304, 305, 4/DIG. 3

[56] References Cited

U.S. PATENT DOCUMENTS

| | | | |
|---|---|---|---|
| 3,863,196 | 1/1975 | Hilles | 4/305 X |
| 4,309,781 | 1/1982 | Lissau | 4/305 X |
| 4,570,272 | 2/1986 | Kawaguchi et al. | 4/305 X |
| 4,624,017 | 11/1986 | Foletta | 4/305 X |
| 4,742,583 | 5/1988 | Yoshida et al. | 4/304 X |
| 4,872,485 | 10/1989 | Laverty, Jr. | 251/129.04 X |
| 4,941,219 | 7/1990 | Van Marcke | 4/304 X |
| 5,063,622 | 11/1991 | Tsutsui et al. | 4/304 X |

*Primary Examiner*—John Rivell
*Attorney, Agent, or Firm*—Ladas & Parry

[57] ABSTRACT

There is provided an automatic cleaner for a male urinal comprising: a sensor such as pyroelectric sensor, etc. for detecting that a human body comes close to the urinal or away therefrom to output a first signal, an one-shot multivibrator circuit of the retriggerable type triggered in response to the outputted first signal to output a second signal for a predetermined time, an infrared ray emitting circuit adapted for emitting infrared rays in the form of pulse for a time period during which the one-shot multivibrator circuit is outputting the second signal, and an infrared ray receiving circuit adapted for detecting that the emitted infrared rays are reflected by the human body to output a third signal in the form of pulse. This automatic cleaner further comprises a circuit responsive to the outputted third signal to trigger the one-shot multivibrator circuit independently of said first signal, a drive circuit adapted for counting the number of the outputted third signals to output a drive signal when the count value reaches a predetermined number of times, and there results the state where the third signal is not outputted, and a cleaning water control unit responsive to the drive signal to allow cleaning water to flow out.

27 Claims, 4 Drawing Sheets

AUTOMATIC CLEANER FOR MALE URINAL

BACKGROUND OF THE INVENTION

This invention relates to a device adapted for automatically cleaning a male urinal, and more particularly to an automatic cleaner for a male urinal and which can be used in the state attached on an existing flush valve portion.

As conventional automatic cleaners for male urinals, there is known an automatic cleaner disclosed in the Japanese Utility Model Application No. 154070/1987. In this automatic cleaner, a pyroelectric sensor is used to detect proximity of a human body to cause a switch circuit to be turned ON to allow an infrared ray sensor or a ultrasonic sensor to be operative to detect that human body and carry out cleaning. In the case of the pyroelectric sensor, however, only a change in the quantity of far infrared rays, i.e., movement of the human body can be detected. For this reason, there was the problem that when a human being stands still in front of the urinal, the switch circuit is turned OFF so that a current to the infrared ray sensor or the ultrasonic sensor is stopped, thus failing to carry out cleaning. In such an automatic cleaner, there was the problem that even if an output of the pyroelectric sensor is held by a hold circuit or a timer circuit, the infrared ray sensor or the ultrasonic sensor may be stopped for a time period during which any person urinates, or the infrared ray sensor or the ultrasonic sensor may be unnecessarily operative after any person has urinated and flushed water, resulting in waste of power.

Some automatic cleaners have a pre-cleaning function to carry out cleaning before the human being urinates. However, there was the problem that pre-cleaning is carried out as human being only passes in front of the urinal, so cleaning water is wasted. Moreover, there are instances where a device having pre-cleaning function is unnecessary. Accordingly, it is necessary to select whether or not pre-cleaning should be carried out. However, conventional devices had no such selective function. It is to be noted that pre-cleaning is carried out in order to allow the urinal to be wet in advance before use so that no stain or dirt is attached. Accordingly, while pre-cleaning is unnecessary in the case where the urinal is wet before use because of continuous use, since it is impossible to properly use such a pre-cleaning function in certain circumstances, cleaning water was wastefully or uselessly consumed.

Further, in the case where men stand in row in front of the urinal, radiated or emitted infrared rays were continuously reflected. As a result, such a state was detected as if one man continues to use the urinal. Thus, there were instances where the urinal failed to be cleaned even after respective persons had used the urinal.

Further, in the case of confirming whether or not a newly installed automatic cleaner operates normally, a person must stand in front of the urinal in the prior art, resulting in consumed time.

Furthermore, automatic cleaners generally use a battery as a power supply, and one cannot therefore know when the battery should be exchanged. Accordingly, there were instances where the state where the battery has run down may be continued, or a battery runs down in a time period during which the push-button is pushed down, so cleaning water continues to flow.

In addition, there is a time lag until cleaning water is caused to automatically flow after one has used the urinal. For this reason, there were instances where the user cannot recognize that automatic cleaning is carried out.

Meanwhile, the reason why the pyroelectric sensor is used is to save energy. Namely, in order to allow infrared ray sensors or ultrasonic sensors having a large current consumption to be operative only for a fixed time from the time point when human body becomes close to such sensor (urinal) or away therefrom, it is detected by a pyroelectric sensor having a small current consumption that the human body becomes close to such sensor or away therefrom. However, a power supply for driving the pyroelectric sensor itself is required. Since automatic cleaners are used at places related to water such as laboratory, there are instances where no plug socket of AC 100 volts is provided by taking safety into consideration. In view of this, a battery is generally used as a power supply for pyroelectric sensor, but use of such battery is inconvenient in that exchange thereof is required.

As described above, conventional automatic cleaners involved many problems relating to saving of resources and saving of energy.

SUMMARY OF THE INVENTION

This invention has been made in view of the above-described circumstances, and its object is to provide an automatic cleaner for a male urinal capable of attaining saving of resources and of energy.

An automatic cleaner for a male urinal according to this invention comprises a sensor for detecting that the human body becomes close thereto or away therefrom to output a first signal, a retriggerable one-shot multivibrator triggered in response to the outputted first detection signal to output a second signal for a predetermined time, an infrared ray emitting circuit for emitting infrared rays in the form of pulse for a time period during which the second signal is being outputted, an infrared ray receiving circuit adapted for detecting that the emitted or radiated infrared rays are reflected by the human body to output a third signal in the form of pulse, a circuit responsive to the third signal to trigger the one shot multivibrator circuit independently of the first signal, a drive circuit adapted to count how many number of times the third signal is outputted to output a drive signal when the count value reaches a predetermined number of times, and there results the state where the third signal stops being outputted, and a cleaning water control unit responsive to the drive signal to allow cleaning water to flow or drain out.

In accordance with the automatic cleaner according to this invention thus constructed, when proximity of the human body is detected by the sensor, a first signal is outputted. The one shot multivibrator circuit is triggered by the first signal to output a second signal for a predetermined time. When the second signal is outputted, the infrared ray emitting circuit emits or radiates infrared rays in the form of pulses. The infrared ray receiving circuit detects infrared rays reflected by the human body to output a third signal in the form of a pulse. The third signal is inputted to the one-shot multivibrator circuit independently of the first signal. Since this one-shot multivibrator circuit is of the retriggerable type, it continues to output the second signal for a time period during which the third signal is outputted, and until a predetermined time passes from the time when the last pulse is outputted. For this reason, the infrared ray emitting circuit continues to emit infrared rays until the human body is away from the sensor. At this time, the drive circuit is counting third signals. When the count value reaches a predetermined number of times, and the third signal stops being outputted, i.e., it is detected that the human body is away from the sensor, the automatic cleaner outputs a drive signal on the basis of the judgment that the principal or main cleaning should be carried out. When the cleaning water control unit receives this drive signal, it allows cleaning water to flow or drain out to carry out principal or main cleaning. Meanwhile, in the system adapted to detect only movement of the human body to allow a current to flow in the cleaner, when a human body stands in front of the urinal, supply of a current is stopped, so existence of the human body cannot be detected, leading to the state where cleaning cannot be carried out. On the contrary, the automatic cleaner according to this invention is constructed to detect proximity of the human body thereafter to emit infrared rays to detect whether the human body is present or away from the sensor to carry out cleaning. For this reason, definite or reliable cleaning can be made. In addition, since a method is employed to emit infrared rays only for a time necessary until a human body is away from the sensor after it is detected that a human body becomes closer to the sensor, power consumption is reduced.

In this invention, the automatic cleaner may further include a pre-cleaning circuit adapted to count third signals supplied from the infrared ray receiving circuit to allow the drive circuit to output the drive signal when the count value reaches a second predetermined number of times smaller than the first mentioned predetermined number of times.

In the case where such a pre-cleaning circuit is provided, the automatic cleaner (the pre-cleaning circuit) judges that a man does not merely pass in front of the urinal, but uses it when the count value of third signals reaches the second predetermined number of times to allow the drive circuit to output a drive signal to carry out cleaning. Accordingly, pre-cleaning is carried out only in the necessary case, thus making it possible to improve the cleaning effect, and to reduce a quantity of cleaning water consumed.

The automatic cleaner may include a switch for stopping the operation of the pre-cleaning circuit.

For example, there are instances where pre-cleaning should not be carried out in order to save water, for example. To meet such situations, the above-mentioned switch for stopping the operation of the pre-cleaning circuit is provided, thereby making it possible to select the pre-cleaning function.

Further, the automatic cleaner may include a continuous use circuit adapted to count third signals delivered from the infrared ray receiving circuit to allow the drive circuit to output the drive signal every time the count value reaches a third predetermined number of times greater than the first-mentioned predetermined number of times.

The state where men are in a row in front of the urinal and continuously use it is detected as if one man stands without being away therefrom. In view of this, the provision of a continuous use circuit as mentioned above permits the drive circuit to output a drive signal every time the count number of third signals reaches the third predetermined number of times irrespective of whether or not one is away from the sensor (or urinal) to carry out cleaning. Thus, a high cleaning effect can be provided.

Further, the automatic cleaner may include a pre-cleaning stop circuit adapted to measure a time elapsed after the drive signal is outputted from the drive circuit to stop the operation of the pre-cleaning circuit until a predetermined time has passed.

In the automatic cleaner provided with the above-mentioned pre-cleaning circuit, when there is further provided a pre-cleaning stop circuit as described above, the following advantage is provided. Namely, for a time period until a predetermined time has passed from the time when a drive signal is outputted, i.e., the last cleaning is carried out, the urinal is wet. Accordingly, in this case, the operation of the cleaning circuit is stopped on the basis of the judgment that it is unnecessary to carry out pre-cleaning. Thus, a quantity of cleaning water consumed is reduced.

Further, the automatic cleaner may include an inspection circuit adapted to allow the drive circuit to output the drive signal even if no third signal is outputted from the infrared ray receiving circuit.

In the case where the automatic cleaner includes such inspection circuit, it is possible to easily inspect or examine whether or not the automatic cleaner operates normally. Namely, without the necessity of examining the automatic cleaner with a man being caused to stand in front of the urinal, such inspection circuit is used to allow the drive circuit to output a drive signal, thereby making it possible to carry out inspection.

Further, the automatic cleaner may include means adapted to stop the drive circuit outputting the drive signal for a time period during which the cleaning water control unit is operative.

For a time period during which the cleaning water control unit is operative, this stop means is used to stop the drive circuit outputting a drive signal. Erroneous operation can be prevented without obstructing the operation of the cleaning water control unit allowing cleaning water to flow out.

The cleaning water control unit may include a power supply, and the automatic cleaner may further include a power supply, and the automatic cleaner may further include a power supply voltage detection circuit operative to allow a display means to carry out display during cleaning when the power supply voltage is lowered to a value less than a first reference value, and to stop the operation of the infrared ray emitting circuit when the power supply voltage is further lowered to a value less than a second reference value lower than the first reference value.

In the case where the automatic cleaner includes such a power supply voltage detection circuit, when the power supply voltage of the cleaning control unit is less than the first reference voltage, the display means displays this during cleaning. Thus, user is notified of this. When the power supply voltage is lowered to less than the second reference voltage, the operation of the infrared ray emitting circuit is stopped.

In the case where the cleaning water control unit allows cleaning water to flow out, means for notifying this by sound may be provided.

While there is a time lag until cleaning water is caused to flow out after use, the user is notified by sound that cleaning is automatically carried out.

Further, a solar cell or battery may be used as the sensor, and a secondary battery assembled by this solar battery may be charged.

In the case where a solar cell or battery is used as the sensor, a power supply adapted to deliver a power to the sensor itself is not required. Thus, saving of energy is realized.

In the case where an output of the solar cell used as the sensor is employed also for charging a secondary battery assembled for driving respective circuits, energy is further saved, and the labor required for exchange of battery becomes unnecessary.

DESCRIPTION OF THE PREFERRED EMBODIMENTS

Preferred embodiments of this invention will now be described with reference to the attached drawings.

Figure 1:
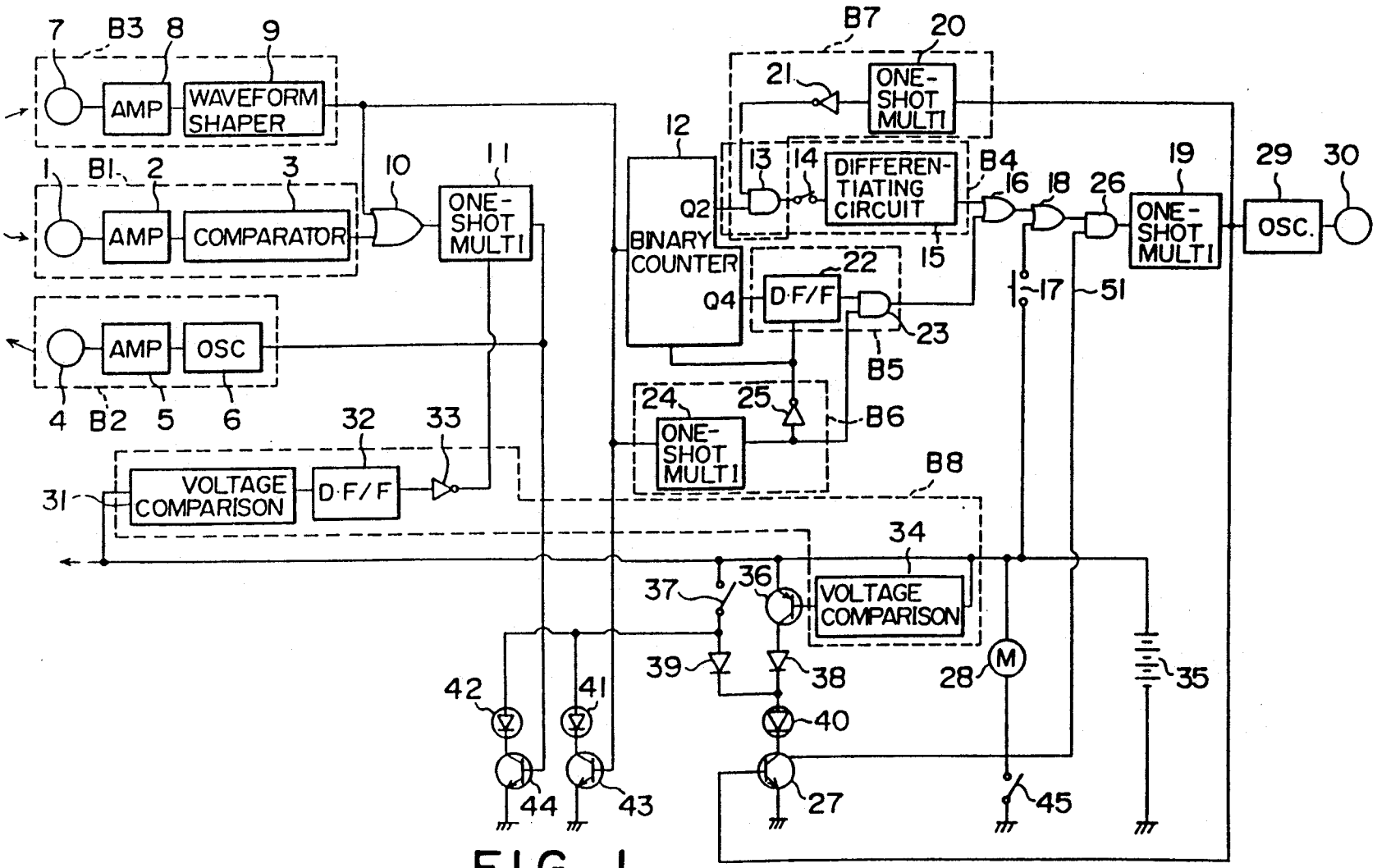
FIG. 1 is a block diagram showing a circuit configuration of an automatic cleaner for a male urinal and according to an embodiment of this invention.

The circuit configuration of an automatic cleaner for a male urinal according to an embodiment of this invention is shown in FIG. 1. The entire circuit is composed of principal or main circuit blocks as described below: a circuit block B1 comprised of a pyroelectric sensor 1, an amplifier 2 and a comparator 3; a circuit block B2 comprised of an infrared ray emitting diode 4, an amplifier 5 and an oscillator 6; a circuit block B3 comprised of a phototransistor 7, an amplifier 8, and a waveform shaping circuit 9; a circuit block 4 comprised of an AND circuit 13, a switch 14, and a differentiating circuit 15; a circuit block B5 comprised of a D-type flip-flop 22 and an AND circuit 23, a circuit block B6 comprised of a one shot multivibrator 24 and an inverter 25; a circuit block B7 comprised of an AND circuit 13, an inverter 21, and one shot multivibrator 20; and a circuit block B8 comprised of a voltage comparison circuit 31, a D flip-flop 32, an inverter 33, and a voltage comparison circuit 34.

First, the circuit block B1 detects, from the fact that a quantity of far infrared rays changes, that a man becomes close to the urinal. The circuit blocks B2 and B3 detects, from the fact that emitted infrared rays are reflected, that a man stands in front of the urinal. The circuit block B2 emits infrared rays toward the space in the form of pulse at a fixed interval, and the circuit block B3 receives rays of light of infrared ray pulses irregularly reflected by the human body of the emitted infrared ray pulses and converts such infrared ray pulses to an electric signal to amplify them.

The circuit block B4 serves to judge whether or not pre-cleaning should be carried out when a man becomes close to the urinal and continuously stands there for more than about 2 seconds, thus allowing a pre-cleaning mechanism (not shown) to carry out pre-cleaning. Further, this circuit block B4 also has a function to select pre-cleaning. The circuit block 5 serves to judge whether or not the principal or main cleaning should be carried out after use. This circuit block B5 judges that a man has urinated when he continuously stands in front of the urinal for more than about 8 seconds and is away therefrom to allow a main cleaning mechanism (not shown) to carry out the principal or main cleaning. The circuit block B6 serves to detect that emitted infrared ray pulses are irregularly reflected by the human body and are returned to an infrared light source. This circuit block B6 judges whether a man continuously stands in front of the urinal, or is away from the urinal.

The circuit block B7 serves to judge that it is unnecessary to carry out pre-cleaning for three minutes after a last cleaning is carried out because the urinal is still wet, to thus stop the pre-cleaning function. The circuit block B8 serves to display that the voltage of the battery is lowered, or to stop emission or radiation of infrared ray pulses.

Figure 2:
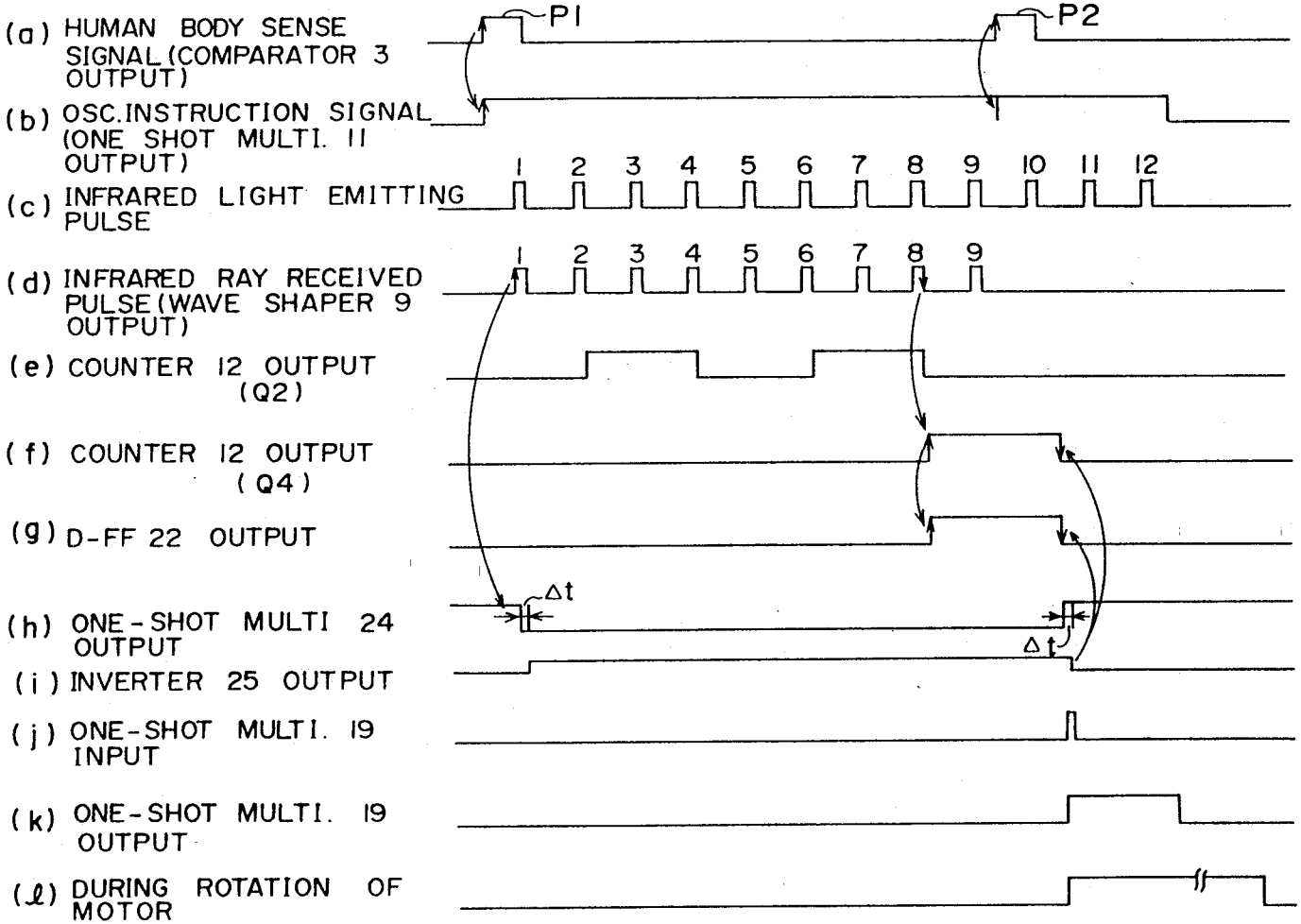
FIG. 2 is a time chart showing operation waveforms of respective signals in the case where the pre-cleaning function is not selected in the above-mentioned automatic cleaner.

The operation of this cleaner provided with principal or main circuit blocks B1 to B8 thus constructed is as follows. Explanation will be given with reference to FIG. 2 showing operation waveforms of respective signals corresponding to the case where the pre-cleaning function is not selected.

As a power supply 35 (FIG. 1), four dry batteries connected in series are used. Thus, the entirety of the circuit is energized at all times.

When a man becomes close to the urinal or away therefrom, it is detected by the pyroelectric sensor 1 of the circuit block B1 that the reflected quantity of infrared rays changes. Such a change is converted to an electric signal. This electric signal is amplified to a required level by the amplifier 2, and is then inputted to the comparator 3. When that input signal is above a threshold value set in advance, a voltage of high level is outputted from the comparator 3. The pulse Pl of FIG. 2(*a*) corresponds to the pulse which has detected that a man becomes close to the urinal, and the pulse P2 corresponds to the pulse which has detected that a man is away from the urinal.

An output signal from the comparator 3 is inputted to a one-shot multivibrator 11 via an OR circuit 10, and is triggered in response to the fall of the pulse Pl. This one shot multivibrator 11 provides an output of high level for about three seconds once it is triggered. When a trigger operation is further carried out (hereinafter referred to as a retrigger operation) for a time period while the output is at high level, the state of high level is maintained for about 3 seconds after the one shot multivibrator is last triggered. FIG. 2(*b*) shows an output of this one-shot multivibrator 11. This one-shot multivibrator 11 is triggered by the pulse Pl from the comparator 3 so that the output shifts to high level, and is retriggered by the pulse (FIG. 2(*d*)) outputted from the waveform shaping circuit 9 of the circuit block B3 (which will be described later) so that the output is maintained at high level.

The oscillator 6 in the block B2 outputs pulses having a width of about 500 $\mu$ seconds at an interval of about 1 second for a time period during which an output from the one shot multivibrator 11 is at high level, i.e., from the time when it is detected that a man becomes close to the front portion of the urinal. The amplifier 5 current-amplifies this output to drive the infrared ray emitting diode 4 to emit infrared rays in the form of pulses. FIG. 2(*c*) shows the case where 12 infrared ray pulses are outputted.

When a man stands in front of the urinal, emitted infrared ray pulse are reflected. These reflected infrared rays are received by the phototransistor 7 of the circuit block B3, and are then converted to an electric signal. The converted electric signal is amplified by the amplifier 8, and is outputted, as shown in FIG. 2(*d*), as a signal shaped so that it is in the form of pulse by the waveform shaping circuit 9. The output signal thus obtained is delivered to the OR circuit 10. On the other hand, when a man is away from the urinal, reflection of infrared rays is stopped. As a result, no pulse is outputted from the waveform shaping circuit 9. When a man is away from the urinal, a pulse P2 which has detected this is inputted from the comparator 3 to the one-shot multivibrator 11 via the OR circuit 10, at which it is triggered. Thereafter, outputting of pulses from the waveform shaping circuit 9 is also stopped. For this reason, as shown in FIG. 2(*b*), the output of the one shot multivibrator 11 shifts to the low level after about three seconds from occurrence of the pulse P2.

An output of the waveform shaping circuit 9 is also delivered to the one-shot multivibrator 24 of the circuit block B6. The one-shot multivibrator 24 is of the retriggerable type. By the first trigger operation, an output of low level is provided for about 1.5 seconds. This output is inverted by the inverter 25, and is inputted to a binary counter 12 and the D-type flip-flop 22 of the circuit block B5, to thus release the reset state. In this way, whether a man stands in front of the urinal or away therefrom is detected at the circuit block B6 in dependency upon whether or not an output at an interval of 1 second from the waveform shaping circuit 9 is continued.

In the case where a subsequent input is not provided within about 1.5 seconds from the time when a first input is provided from the waveform shaping circuit 9 to the one shot multivibrator 24, i.e., reflection of the infrared ray is carried out only once, an output of the one-shot multivibrator 24 shifts to high level after about 1.5 seconds. A signal of low level inverted at the inverter 25 is inputted to the binary counter 12 and the D-type flip-flop 22 to place them in the reset state. When inputting to the one-shot multivibrator 24 is continued, i.e., infrared rays continue to be reflected because a man stands in front of the urinal, the output of the one-shot multivibrator 24 is maintained at low level during that time period (FIG. 2(*h*)). Here, FIG. 2(*i*) indicates an output of the inverter 25 in which there is shown the state where the output of the inverter 25 is delayed by a time $\Delta t$ with respect to the output of the one-shot multivibrator 24 of FIG. 2(*h*).

The binary counter 12 starts a count operation when the output of the one-shot multivibrator 24 falls, and a signal of high level is delivered from the inverter 25. In the case where a second infrared ray received pulse (FIG. 2(*d*)) is outputted, i.e., in the case where more than 2 seconds have passed with a man standing in front of the urinal, and pre-cleaning should be carried out, an output of high level is provided from the terminal Q2 of the binary counter 12. This output is inputted to the AND circuit 13 in the circuit block B4 for judging whether or not pre-cleaning should be carried. To another input terminal of the AND circuit 13, an output of the circuit block B7 for measuring time passed after cleaning is carried out last is also delivered. When this output is at high level, i.e., in the case where more than three minutes have passed from the last cleaning, another cleaning is automatically carried out, as described later.

The output of the AND circuit 13 is delivered to a differentiating circuit 15 in the case where the pre-cleaning function is selected, so the switch 14 is in a closed state. An output of this differentiating-circuit 15 is inputted to an OR circuit 16. To the OR circuit 16, an output from the differentiating circuit 15 relating to the pre-cleaning and an output from the AND circuit 23 of the circuit block B5 relating to the principal or main cleaning are delivered.

An output of the OR circuit 16 is delivered to an AND circuit 26 via an OR circuit 18. When an input to another input terminal 51 which will be described later is at high level, the output of the OR circuit 16 triggers the one-shot multivibrator 19. The one-shot multivibrator 19 is adapted to maintain an output of high level for about 5 seconds when trigger operation is provided once. This output serves as a signal to drive a motor 28 for automatically pushing down a push button of the flush valve. When this signal is given, the motor 28 rotates. As a result, the cleaning switch is pushed down. Thus, cleaning is carried out. It should be noted that the operation waveforms of FIG. 2 indicate the case for when the pre-cleaning function is not selected, so the switch 14 is turned OFF. For this reason, pulses for pre-cleaning are not included in an output from the one-shot multivibrator 19 shown in FIG. 2(*k*).

The binary counter 12 is supplied with an output from the waveform shaping circuit 9 after a second infrared ray received pulse is inputted to count the number of received infrared ray pulses. In response to the fall of the eighth pulse, the output from the terminal Q4 rises to high level (FIG. 2(*f*)). When this output is delivered to the D-type flip-flop 22 of the circuit block B5, the flip-flop is held at a high level. As a result, an output of high level is outputted (FIG. 2(*g*)).

When no signal indicative of reflected infrared rays is detected after the ninth infrared ray received pulse, the output of the one-shot multivibrator 24 shifts to high level, the output from the AND circuit 23 shifts to high level. However, when the output of the one-shot multivibrator 24 shifts to high level, a signal of low level inverted at the inverter 25 is inputted to the binary counter 12 so that the counter is reset. For this reason, the output of the AND circuit momentarily returns from high level to low level. The time at which the output of the AND circuit 23 is at high level is equal to sum of times respectively delayed by the inverter 25 and the D-type flip-flop 22.

An output of the OR circuit 16 is delivered to the AND circuit 26 via the OR circuit 18. When an input to the input terminal 51 is at high level, the output of the OR circuit 16 triggers the one-shot multivibrator 19. The one-shot multivibrator 19 is adapted to maintain an output of high level for about 5 seconds when a trigger operation is provided once. This output serves as a signal (FIG. 2(*k*)) to drive the motor 28 for automatically pushing down the push button of the flush valve. When this signal is given, the motor 28 rotates for a time period shown in FIG. 2(L) because a microswitch 45 is closed. Thus, cleaning is carried out.

As described above, before about three minutes have passed from the time when cleaning is carried out last, the urinal is still wet. Therefore, there is no necessity of carrying out pre-cleaning. The function to stop such pre-cleaning is provided by the circuit block B7. The one-shot multivibrator 20 of the circuit block B7 is of the retriggerable type such that it is triggered when the output of the one-shot multivibrator 19 rises, and is adapted to output a signal of high level for about three minutes when triggered once. This output is inverted by the inverter 21, and is then inputted to the AND circuit 13 as a signal of low level. Thus, when the motor is driven once, an output (terminal Q2) of the binary counter 12 is not delivered to the AND circuit 13 for about three minutes. As a result, pre-cleaning is not carried out. After three minutes, the output of the one-shot multivibrator 20 shifts to low level, so a signal of high level is delivered from the inverter 21 to the AND circuit 13. For this reason, the output of the binary counter 12 is inputted to the differentiating circuit 15 Thus, pre-cleaning is carried out.

Further, also in the case where more than three minutes have passed from the time when pre-cleaning is carried out last, and men stand in row in front of the urinal, the output of the one-shot multivibrator 20 shifts to low level in the same manner as in the case where one man is away from the urinal. Thus, an output of high level inverted by the inverter 21 is delivered to the AND circuit 13, and an output from the terminal Q2 of the binary counter 12 is inputted to the AND circuit 13. When an output of high level is provided from the terminal Q2 of the binary counter 12, an output of high level is provided from the AND circuit 13. As a result, the one-shot multivibrator 19 is triggered. Thus, cleaning is carried out. As described above, when men stand for a long time, cleaning is automatically carried out at a time interval of three minutes. Thus, a high cleaning effect is obtained.

An output of the one-shot multivibrator 19 is delivered to a transistor 27, at which it is current-amplified, resulting in a signal for driving the motor 28. This signal is also used for lighting a display LED 40. The motor 28 starts rotation when the transistor 27 becomes conductive. When the motor 28 begins rotating, the microswitch 45 is closed. Thus, the motor 28 continues to rotate to the initial position where the push-button is pushed down.

The output of the one-shot multivibrator 19 is also delivered to the oscillation circuit 29. This oscillation circuit 29 serves to drive a piezo electric buzzer 30. When the output of the one-shot multivibrator 19 shifts to high level, the oscillation circuit 29 beings oscillating to inform by sound that cleaning is carried out.

Between the input terminal of the OR circuit 18 and the plus terminal of the power supply 15, a push-switch 17 is connected in series. This push-switch 17 is turned ON at the time of testing whether or not the automatic cleaner normally operates in attachment or installation thereof. When this push-switch 17 is turned ON, the motor 28 is forcedly driven. Thus, cleaning is carried out.

The input terminal 51 of the AND circuit 26 is provided in order to attain the following operation. Namely, for a time period during which the motor 28 rotates, even if the push-switch 17 is turned ON, or an input from the OR circuit is provided in order to subsequently carry out cleaning, the input terminal 51 inhibits to deliver its input to the one-shot multivibrator 19 so that the motor 28 is not driven. When a drive signal is outputted from the one-shot multivibrator 19 during rotation of the motor 28, there is the possibility that the time at which the push button is pushed down is prolonged so that cleaning water becomes wasteful or useless, or the positional relationship where the microswitch 45 interlocks with rotation of the motor 28 may be disordered. However, such circumstances can be avoided by the provision of the input terminal 51.

In the circuit block B8 for detecting lowering of a voltage of the power supply 35, the voltage comparison circuit 31 compares a voltage of the power supply 35 with 4 volts to output a signal of high level when the voltage of the power supply 35 is below 4 volts. This signal is delivered to the D-type flip-flop 32. As a result, an output of high level is provided. This signal is inverted by the inverter 33. The signal thus obtained is inputted to the one-shot multivibrator 11 as a signal of low level. Thus, the one-shot multivibrator 11 is reset irrespective of an input from the OR circuit 10. When the one-shot multivibrator 11 is reset, oscillation of the oscillation circuit 6 of the circuit block B2 is stopped. Thus, the infrared ray pulses ceases to be emitted.

Here, in the case where the voltage of the power supply 35 is less than 4 volts, only the one-shot multivibrator 11 is reset, but other circuit operations are not affected thereby. For this reason, even during cleaning, the operation of the automatic cleaner is not stopped in the middle of cleaning. Thus, one can return the push-button to the initial position, resulting in no possibility that cleaning water is caused to continuously and infinitely flow out. The voltage comparison circuit 34 serves to detect a voltage of the power supply 35 in the same manner as in the case of the voltage comparison circuit 31. When the voltage of the power supply 35 is less than 4.5 volts, the voltage comparison circuit 34 provides an output of low level. This output is delivered to the base of a transistor 36 so that the transistor 36 becomes conductive.

Moreover, for a time period during which the output from the one-shot multivibrator 19 is at high level, the transistor 27 becomes conductive. Further, the microswitch 45 is closed when the push-button begins to be pushed down. Thus, even if the switch 37 is not turned ON, a current flows in the LED 40. As a result, the LED 40 is lighted. When the power supply voltage is less than 4.5 volts as stated above, the LED 40 is lighted during cleaning to inform that the dry battery should be exchanged. Here, the switch 37 is ordinarily in an OFF state in order to suppress consumption of the battery 35. When the automatic cleaner is attached or installed to make adjustment, the switch 37 is closed in order that the operation state can be confirmed. Here, the microswitch 45 is adapted so that it is opened when the push-button is completely pushed down and is returned to the initial position.

The switch 14 of the circuit block B4 serves to select the function of pre-cleaning. In the case where the switch 14 is turned ON, pre-cleaning is carried out. In contrast, in the case where the switch 14 is cut OFF, only principal or main cleaning is carried out.

A LED 41 serves to display presence and absence of reflection of infrared ray pulses. In the case where there is any reflection, the transistor 43 is turned ON by an output from the waveform shaping circuit 9 of the circuit block 3. As a result, a current flows in the LED 41. Thus, the LED 41 is lighted.

A LED 42 serves to indicate that the oscillator 6 of the circuit block B2 is an oscillating state. When the transistor 44 becomes conductive by an output of the oscillator 6, the LED 42 is lighted.

Figure 3:
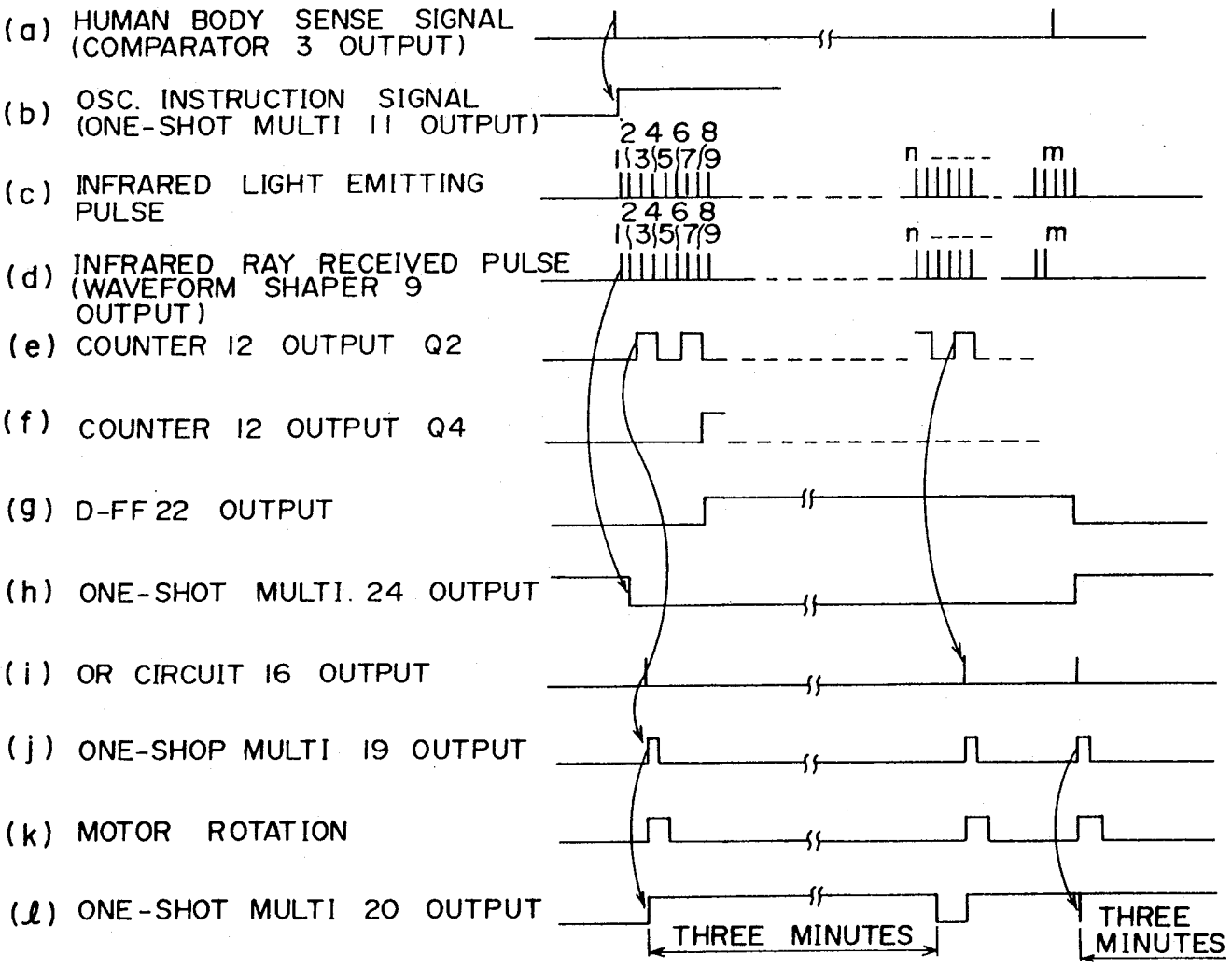
FIG. 3 is a time chart showing operation waveforms of respective signals in the case where the pre-cleaning function is selected in the above-mentioned automatic cleaner.

The operation waveforms of respective signals in the case where the pre-cleaning function is selected are shown in FIG. 3. When compared with the above-described case, this case differs from the former in that the switch 14 of the circuit block B4 is in an ON state. When three minutes have passed from the time when cleaning is last carried out, the one-shot multivibrator 20 of the circuit block B7 falls from high level to low level as shown in FIG. 3(L). This output is inverted by the inverter 21, and a signal of high level is inputted to the AND circuit 13. Thus, an output from the terminal Q2 of the binary counter 12 is placed in the state where it can be passed through the AND circuit 13.

When a man becomes close to the front portion of the urinal, this is detected. As a result, a pulse is outputted from the comparator 3 (FIG. 3(*a*)). As a result, infrared rays are emitted by the circuit block B2 (FIG. 3(*b*)). Thus, m number of infrared rays are received by the circuit block B3 for a time period until the man is away from the urinal (FIG. 3(*c*)).

When the first and second infrared ray received pulses are inputted to the binary counter 12, this counter 12 outputs a signal of high level from the output terminal Q2 (FIG. 3(*e*)). This output is passed through the AND circuit as described above, and is inputted to the OR circuit 16 via the switch 14 and the differentiation circuit 15. As a result, an output of high level is provided as shown in FIG. 3(*i*). This output triggers the one-shot multivibrator 19 (FIG. 3(*j*)), and the motor 28 rotates (FIG. 3(*k*)). Thus, pre-cleaning is carried out.

The rise waveform of the output of this one-shot multivibrator 19 is given also to the one-shot multivibrator 20 of the circuit block B7. Thus, the one-shot multivibrator 20 is triggered by this output to maintain an output of high level for three minutes (FIG. (L)). This output is inverted by the inverter 21, and is inputted to the AND circuit 13 as a signal of low level. For this reason, the output of the binary counter 12 cannot be passed through the AND circuit 13 for three minutes. As a result, pre-cleaning is not carried out. When no man uses the urinal within three minutes, the one-shot multivibrator 20 is not triggered. As a result, the output level returns to low level for a second time. Thus, there results the state where pre-cleaning is carried out.

When a man is away from the front portion of the urinal, so there results the state where the m-th infrared ray and those subsequent thereto are not received, an output of high level is provided from the D-type flip-flop 24 (FIG. 3(*h*)) in the same manner as in the case where the pre-cleaning function is not selected (FIG. 2). This output triggers the one-shot multivibrator 19 via the AND circuit 23, the OR circuits 16 and 18, and the AND circuit 26 (FIG. 3(*j*)). As a result, the motor 28 rotates (FIG. 3(*k*)). Thus, principal or main cleaning is carried out.

In accordance with the above-described embodiment, the following advantages are provided. In a conventional cleaner adapted to allow the switch circuit to be turned ON by the pyroelectric sensor for detecting movement of the human being to cause a current to flow into the infrared ray sensor or the ultrasonic sensor, since when a man stands in front of the urinal, movement thereof is stopped, it was interrupted or stopped that a current is caused to flow. In this embodiment, however, since an approach is employed to trigger the one-shot multivibrator 11 of the retriggerable type by an output of the OR circuit 10, a current is caused to continuously flow into the cleaner. Thus, cleaning is carried out without hindrance.

Further, in accordance with this embodiment, power consumption is reduced. The pyroelectric sensor 1 used in the circuit block B1 is such that its current consumption is a small value of about 15 μA. Further, since a technique is employed such that the amplifier 2 and the comparator 3 are constructed as an integrated circuit of the CMOS structure, the current consumption therefor can be held down to about 50 μA. Thus, the current consumption of the entirety of the circuit block B1 can be caused to fall within a range of about 60 to 70 μA.

On the other hand, in the circuit block B2, in order to sufficiently take a distance permitting detection of the human body, or in order to allow that circuit block not be erroneously operative by undergoing influence of a disturbance light, it is required to cause a large current of about 1A to flow in the infrared ray emitting diode 4. In view of reduction of the power consumption, a technique is employed to shorten the light emitting time, i.e., narrow the pulse width of the infrared ray, thus to reduce an average current consumption. In this case, it is preferable that the light emitting time is set to about 500 μ seconds by the requirement to stabilize the operation of the oscillator 6, etc. Further, according to the pulse interval of the infrared ray is shorter, it can be detected more rapidly that the human being is away from the urinal, if the pulse interval is practically set to about 1 second in order to suppress power consumption.

Further, since a technique is employed to emit infrared rays for a time period from the time when the pyroelectric sensor 1 detects proximity of the human being to the time when the human being is away from the urinal without emitting them at all times, power consumption is reduced.

Further, in accordance with this invention, a quantity of cleaning water consumed can be reduced. In regard to the pre-cleaning function, in the case where a man merely passes through the front of the urinal, the pre-cleaning function is inhibited or stopped by the circuit block B4. Further, this function is inhibited or stopped because it is judged by the circuit block B7 that the urinal is wet for a time period until three minutes have passed from the time when cleaning is carried out last and it is therefore unnecessary to carry out pre-cleaning. Further, even if the battery has run down, so the voltage of the power supply 35 is less than 4 volts for a time period during which the push-button of the flush valve is pushed down, the automatic cleaner continues its operation to the last without being interrupted on the way. For this reason, cleaning water is prevented from infinitely flowing, resulting in no wasteful or useless cleaning water.

In the case where it is not desired to cause cleaning water for pre-cleaning to flow, by cutting OFF in advance of the switch 14 of the circuit block B4, it is possible to inhibit or stop the pre-cleaning function.

In the case where men stand in a row in front of the urinal, this state is detected as if one man continuously uses the urinal. Also in this case, cleaning is periodically carried out at a time interval of about three minutes by the circuit block B7. Thus, a high cleaning effect can be provided.

In the case of carrying out installation work for the automatic cleaner to confirm the operating situations thereof, when the push-switch 17 is caused to be turned ON, the motor 28 is forcedly driven so that cleaning is carried out. For this reason, it is unnecessary to examine the operation with a man standing in front of the urinal.

As a result, time can be prevented from being wastefully consumed.

Further, in cleaning, there is notification by a piezoelectric buzzer 30 that cleaning is automatically carried out.

When the battery is dissipated, so the voltage of the power supply 35 is lowered, the LED 40 is lighted to notify this. This is convenient in knowing exchange time.

It should not be interpreted that the above-described embodiment limits this invention. For example, the circuit configuration shown in FIG. 1 should be considered to be presented as an example. Any circuit configuration different from the above may be employed. Further, it is not necessarily required that the automatic cleaner have the pre-cleaning function and/or the function to carry out cleaning every time a fixed time has passed, for also in the case where men stand in row.

Figure 4:
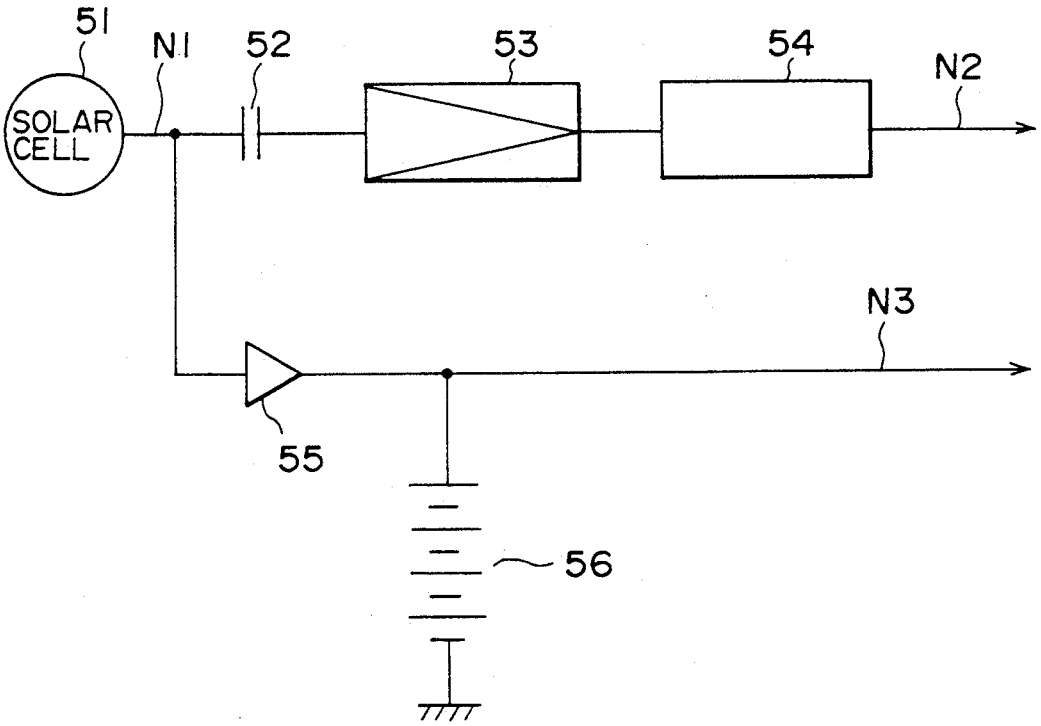
FIG. 4 is a block diagram showing a partial circuit configuration of an automatic cleaner for a male urinal according to another embodiment of this invention.

In the above-described embodiment, as a sensor for detecting that the human body becomes close to the urinal or away therefrom, the pyroelectric sensor 1 in the circuit block B1 is used. However, in addition to such a pyroelectric sensor 1, there may be employed any sensor capable of detecting that the human body becomes close to the urinal or away therefrom. For example, a solar cell or battery may be used. The circuit configuration at the periphery of the sensor in this case is shown in FIG. 4.

A capacitor 52, an amplifier 53, and a waveform shaping circuit 54 are connected in series in order recited to node N1 of the output terminal of solar cell or battery 51. The anode of a diode 55 is connected to the node N1, and a node N3 is connected to the cathode thereof. Between the node N3 and the ground terminal, e.g., nickel-cadmium battery 56 is connected as a secondary battery for delivering power to respective circuits. In the case where the circuit of FIG. 4 is used in place of the block B1 and the battery 35 in the cleaner of FIG. 1, the node N2 is connected to one input terminal of the OR circuit 10, and the node N3 is connected to the terminal on the positive power supply side of the battery 35.

Light is ordinarily irradiated to the solar cell or battery 51. A change in illuminance occurring in the case where the human body becomes close to the urinal or away therefrom appears on the node N1 of the output terminal. The output of the solar cell or battery 51 undergoes a processing such that the d.c. component is eliminated by the capacitor 52, and only a change is amplified by the amplifier 53. Then, the amplified change is subjected to waveform shaping at the waveform shaping circuit 54. The signal thus obtained is outputted from the node N2 as a digital signal.

As stated above, when solar cell or battery 51 is used as a sensor for detecting that the human body becomes close to the urinal or away therefrom, supply of a power to the sensor itself becomes unnecessary, thus making it possible to save energy.

Further, an output of the solar cell or battery 51 is also delivered to the nickel-cadmium battery 56 through the diode 55, and is used for charging. A power outputted from the nickel-cadmium battery 56 is delivered to all the circuits. Thus, the labor to exchange a battery for driving respective circuits can be saved. Thus, energy can be saved to a greater degree.

Here, a photoconductive element may be used, in place of the solar cell or battery, as a sensor for detecting that the human body becomes close to the urinal or away therefrom. There are several kinds of photoconductive elements. For example, there is a photoconductive element using cadmium sulfide (Cds). Also in the case where such a photoconductive element is used in place of the solar cell or battery, the power supply of the sensor itself is unnecessary. Thus, saving of energy can be attained.

What is claimed is:

1. An automatic cleaner for a male urinal comprising:

a sensor for detecting that a human body comes close to the urinal or away therefrom to output a first signal, an one-shot multivibrator circuit of the retriggerable type triggered in response to the outputted first signal to output a second signal for a predetermined time, an infrared ray emitting circuit adapted for emitting infrared rays in the form of pulses for a time period during which said one-shot multivibrator circuit is outputting said second signal, an infrared ray receiving circuit adapted for detecting that the emitted infrared rays are reflected by the human body to output a third signal in the form of pulse, a circuit responsive to the outputted third signal to trigger said one shot multivibrator circuit independently of said first signal, a drive circuit adapted for counting the number of the outputted third signals to output a drive signal when the count value reaches a predetermined number of times, and there results the state where said third signal is not outputted, and a cleaning water control unit responsive to said drive signal to allow cleaning water to flow out.

2. An automatic cleaner for a male urinal as set forth in claim 1, which further comprises a pre-cleaning circuit adapted to count the number of the third signals delivered from said infrared ray receiving circuit to allow said drive circuit to output said drive signal when the count value reaches a second predetermined number of times smaller than said predetermined number of times.

3. An automatic cleaner for a male urinal as set forth in claim 2, which further comprises a switch for stopping the operation of said pre-cleaning circuit.

4. An automatic cleaner for a male urinal as set forth in claim 1, which further comprises a continuous use circuit adapted to count the number of the third signals delivered from said infrared ray receiving circuit to allow said drive circuit to output said drive signal every time the count value reaches a third predetermined number of times greater than said predetermined number of times.

5. An automatic cleaner for a male urinal as set forth in claim 1, which further comprises a pre-cleaning stop circuit adapted to measure a time passed from the time when said drive signal is outputted from said drive circuit to stop the operation of said pre-cleaning circuit for a time period until a predetermined time has passed.

6. An automatic cleaner for a male urinal as set forth in claim 1, which further comprises an inspection circuit adapted to allow said drive circuit to output said drive signal even if said third signal is not outputted from said infrared ray receiving circuit.

7. An automatic cleaner for a male urinal as set forth in claim 1, which further comprises means adapted for interrupting or stopping that said drive circuit outputs said drive signal for a time period during which said cleaning water control unit is operative.

8. An automatic cleaner for a male urinal as set forth in claim 1, wherein said cleaning water control unit includes a power supply, said automatic cleaner further comprising a power supply voltage detection circuit adapted so that when a voltage of said power supply lowers to less than a first reference value, said detection circuit allow display means to display it for a time period during which cleaning is carried out, and when said power supply voltage further lowers to less than a second reference value lower than said first reference value, said detection circuit stops the operation of said infrared ray emitting circuit.

9. An automatic cleaner for a male urinal as set forth in claims 1, wherein in the case where said cleaning water control unit causes cleaning water to flow out, said automatic cleaner includes means for notification by sound.

10. An automatic cleaner for a male urinal as set forth in claim 1, wherein said sensor is a solar cell.

11. An automatic cleaner for a male urinal as set forth in claim 10, wherein an output from said solar cell is also used for charging a secondary battery assembled therein.

12. An automatic cleaner for a male urinal as set forth claims 2, wherein said sensor is a solar cell.

13. An automatic cleaner for a male urinal as set forth in claim 12, wherein an output from said solar cell is also used for charging a secondary battery assembled therein.

14. An automatic cleaner for a male urinal as set forth in claim 3, wherein said sensor is a solar cell.

15. An automatic cleaner for a male urinal as set forth in claim 14, wherein an output from said solar cell is also used for charging a secondary battery assembled therein.

16. An automatic cleaner for a male urinal as set forth in claim 4, wherein said sensor is a solar cell.

17. An automatic cleaner for a male urinal as set forth in claim 16, wherein an output from said solar cell is also used for charging a secondary battery assembled therein.

18. An automatic cleaner for a male urinal as set forth in claim 5, wherein said sensor is a solar cell.

19. An automatic cleaner for a male urinal as set forth in claim 18, wherein an output from said solar cell is also used for charging a secondary battery assembled therein.

20. An automatic cleaner for a male urinal as set forth in claim 6, wherein said sensor is a solar cell.

21. An automatic cleaner for a male urinal as set forth in claim 20, wherein an output from said solar cell is also used for charging a secondary battery assembled therein.

22. An automatic cleaner for a male urinal as set forth in claim 7, wherein said sensor is a solar cell.

23. An automatic cleaner for a male urinal as set forth in claim 22, wherein an output from said solar cell is also used for charging a secondary battery assembled therein.

24. An automatic cleaner for a male urinal as set forth in claims 8, wherein said sensor is a solar cell.

25. An automatic cleaner for a male urinal as set forth in claim 24, wherein an output from said solar cell is also used for charging a secondary battery assembled therein.

26. An automatic cleaner for a male urinal as set forth in claim 9, wherein said sensor is a solar cell.

27. An automatic cleaner for a male urinal as set forth in claim 26, wherein an output from said solar cell is also used for charging a secondary battery assembled therein.

* * * * *